United States Patent [19]

Attaway

[11] Patent Number: 4,512,127

[45] Date of Patent: Apr. 23, 1985

[54] MOLDINGS

[75] Inventor: Julian J. Attaway, Tucker, Ga.

[73] Assignee: MM Systems Corporation, Tucker, Ga.

[21] Appl. No.: 492,020

[22] Filed: May 5, 1983

[51] Int. Cl.[3] ..... E04F 13/06

[52] U.S. Cl. ..... 52/288; 52/716

[58] Field of Search ..... 52/288, 255, 278, 716, 52/717

[56] References Cited

U.S. PATENT DOCUMENTS 3,371,456 3/1968 Balzer et al. ..... 52/288 X 3,486,283 12/1969 Arnett ..... 52/288 X

*Primary Examiner*—J. Karl Bell

*Attorney, Agent, or Firm*—John B. Armentrout

[57] ABSTRACT

A molding wherein first and second molding shafts are adapted to be attached to a building is provided to produce relatively movably a recessed reveal adjacent to outside surfaces of first and second structural bodies, at least one of the two structural bodies being either of a dry wall or of a fluent settable type having the related one of the molding shafts serve as a ground for the dry wall or fluent settable type material, the first molding shaft furthermore having in the structure thereof a corner to accommodate sub-structure of the building, thus enabling the molding, as installed, to have at least the second molding shaft thereof attached to the aforementioned sub-structure for producing the recessed reveal with the first molding shaft, while portions of the two shafts are proximately relatively movable with the shafts to allow the reveal to adjust, and while the attachments, including a portion of the corner structure of the first molding shaft and an attaching portion of the second molding shaft, are concealed.

20 Claims, 14 Drawing Figures

Fig. 1
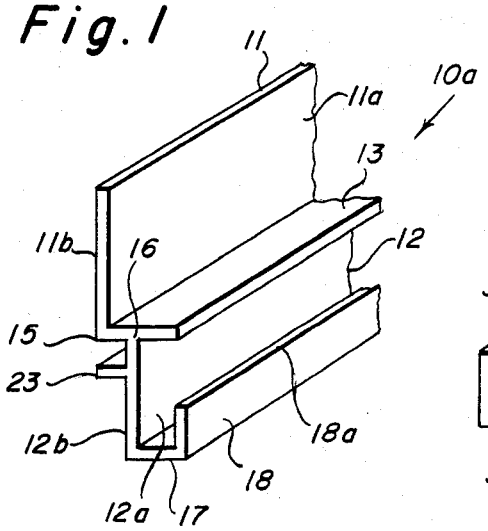
Fig. 2
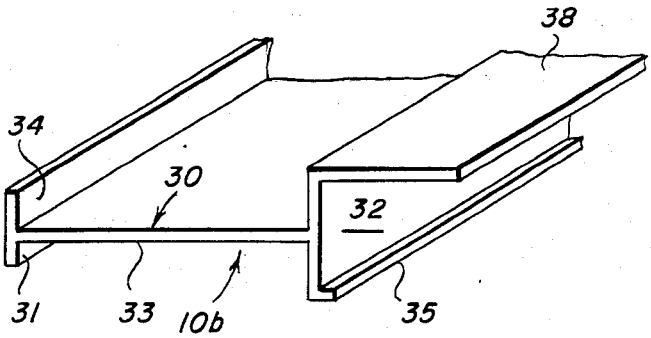
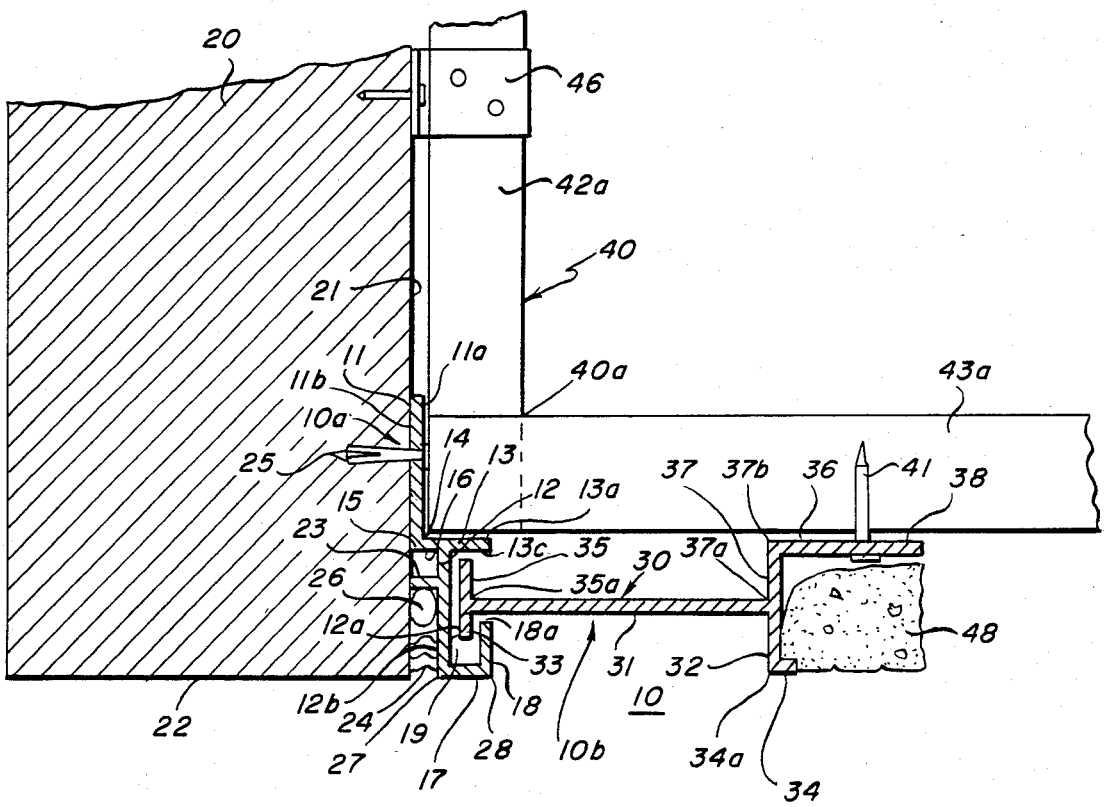
Fig. 3

MOLDINGS

The present invention relates to architectural components for buildings and more particularly to moldings for use both for a ground and for trim adjacent to finish material, and the invention also relates to building structures including the molding installed.

An object of the present invention is the provision of an architectural molding which is well suited for use externally of sub-structure of a building and with either or both dry wall or fluent settable finish material, and which molding is readily fabricated, such as by extrusion, and is inclusive of two molding shafts which are adapted to be fastened interrelated to a building so as to tolerate relative movement of the two shafts with reference to one another and produce a reveal and otherwise be concealed by portions of the building desirably exposed adjacent to the reveal.

Another object of this invention is to provide an architectural molding of the character indicated which, upon being connected with existing building structure, tolerates first and second directional relative lateral and third directional relative longitudinal movements in the molding itself to compensate for expansion and contraction and absorb shocks and vibrations, experienced by the building structure carrying the molding, and which molding also when in place introduces wall structure to provide a ground for finish material along with a recessed trim reveal.

A further object herein is the provision of moldings of the character indicated wherein the recessed reveal is in part presented by each of the two relatively movable molding shafts, and areas of both of the molding shafts contribute inside the recess to the reveal.

Other objects of this invention in part will be obvious and in part pointed out more fully hereinafter.

As conducive to a clearer understanding of certain features of the present invention, it will be noted at this point that in the field of architectural trim for building construction, various finish materials are available to be put into place in a building along with moldings which are needed adjacent to the finish material for trim. Among moldings of this general kind which are in demand are those having utility with finish material not only to satisfy a need for being a ground for the finish material while the latter is being installed, but to have the molding thereafter in part exposed as trim, referred to herein as a reveal, with the remainder of the molding being concealed from view. Moldings of the latter sort are advantageous for being a ground for finish materials such as plaster, which is to be used in a fluent settable condition against the molding, or for so-called dry wall material, such as paneling or boarding, which is preformed and is subsequently to be placed against the molding.

In working from the surface of a structural body already in situ in a building, such as from a wall surface or from the side face of a column or of a beam, moldings are often needed for a side of the molding to be in contact with the structural body surface and have the molding be a ground for finish material which later is to lead toward the structural body, outside a sub-structure of the building while aside from the structural body, so as to have the molding provide a trim reveal between the finish material and the structural body. In other instances, moldings are beneficial for the molding to satisfy being a ground and a trim reveal between finish material added to each of opposite sides of the molding after the molding has been put into place in a building.

The present invention provides moldings, such as for use in any one or more of the aforementioned environments, and the moldings beyond being satisfactory for serving as grounds for finish material are characterized by tolerating relative mobility within the molding itself while producing an attractive trim reveal which longitudinally of the molding is laterally recessed. This entails using a pair of relatively movable molding shafts in the molding, the first of which shafts includes corner structure adapted to be behind the reveal and be in a fastened condition to the building while receptively associated with sub-structure of the building. The second molding shaft meanwhile is suited to be fastened to the sub-structure so as to have the resulting reveal, produced by the two shafts, eventually be intermediately of first and second structural bodies, at least one of which bodies is characterized by being of a dry wall or of a fluent settable type. Because of the ability to move within itself in the particular environment, the molding can interrupt thrusts resulting from such causes as earth tremors, explosions, or thrusts from expansion or contraction of the related structure of the building, such for example as would be caused by a differential in temperature or humidity in one and the other of different locations proximate to the molding.

In the accompanying drawings representing several embodiments of the present invention which are offered by way of example and among which are those presently preferred:

FIGS. 1 and 2 respectively are isometric fragmentary views of first and second shafts of a plural shaft molding;

FIG. 3 is a transverse cross-sectional assembly view, of the first and second molding shafts according to FIGS. 1 and 2, in an installation;

FIGS. 4, 5 and 6 also provide assembly views of the molding shafts of FIGS. 1 and 2, though with the plural shaft molding installed in environments other than the FIG. 3 environment;

Figure 4:
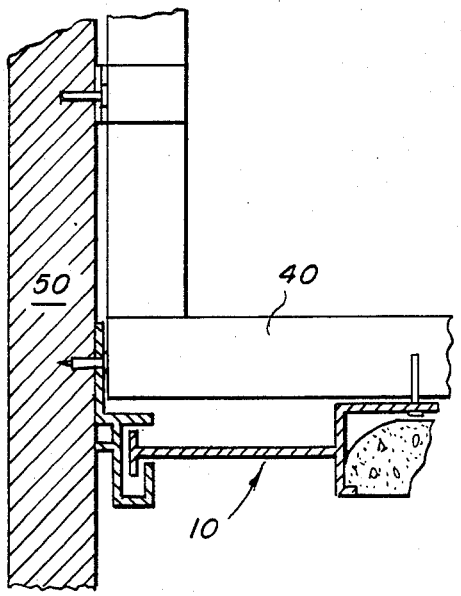

In the embodiment represented in FIGS. 1, 2 and 3, herein, a molding 10 comprises first and second molding shafts respectively designated generally by the reference numerals with letters 10*a* and 10*b*. As will be understood from FIG. 3, shafts 10*a* and 10*b* are laterally and longitudinally relatively movably associated with one another, being for example extrusions made from an aluminum base alloy or of any other suitable metal or material. The first molding shaft 10*a* is characterized by including first and second wall portions 11 and 12 and a third wall portion 13 co-extending longitudinally of the first molding shaft 10*a* with one another. Adjacent first ends of the first and second wall portions 11 and 12 are joined with the third wall portion 13, having the first wall portion 11 at inner face 11*a* form about a right angle corner 14 with the rearward face 13*a* of the third wall portion 13, and having the second wall portion 12 lead laterally in the first molding shaft 10*a* in a forward direction outside the corner 14 in approximately a right angle relation to the third wall portion 13. More particularly, a junction 16 of the second wall portion 12 with the third wall portion 13 is offset from a junction 15 of the first wall portion 11 with the third wall portion 13 so that when the first wall portion 11 is fastened, as by expansion fasteners 25, with the outside face 11*b* thereof against an existing contact surface 21 of a building the second wall portion 12, being indented, forms a gap 26 at outside face 12*b* thereof with the existing contact surface 21 for the gap 26 to be filled such as by an elastomeric strip or caulking 24 represented in FIG. 3. In the installation according to FIG. 3, the existing contact surface 21 referred to above is a side face of a ceiling beam 20 which presents a horizontal downwardly exposed forward face 22 in the building structure.

A sub-structure 40 of the building is represented in FIG. 3 as being aside from the existing contact face 21 of the ceiling beam 20 and includes a plurality of L-shaped frame members 40*a*, one of which is shown also in FIG. 3. Each of the L-shaped members has legs 42*a* and 43*a*, such as of wood, about right angularly disposed relatively to one another and forming an outside corner which is accommodated inside the corner 14 in the first molding shaft 10*a* after the first wall portion 11 thereof has been secured by the fasteners 25 to the ceiling beam 20. The L-shaped frame member 40*a* are spaced side by side from one another longitudinally along the first molding shaft 10*a*, having the legs 42*a* in substantially vertical positions and secured by clips 46 fastened outside the existing surface 21 to the ceiling beam 20, and having the legs 43*a* maintained in substantially horizontal positions outside the corner 14 in the first molding shaft 10*a* any suitable manner not shown.

A web wall portion 17 of the first molding shaft 10*a* interconnects a laterally rearwardly directed supplemental flange wall 18 at a laterally foward end of the latter with a laterally forward second end of the second wall portion 12 in the first molding shaft 10*a*, thus producing junctions 27 and 28. The web wall portion 17 and the supplemental flange wall 18 co-extend longitudinally integrally with the first, second and third wall portions 11, 12 and 13 and accordingly define a rearwardlly laterally open longitudinal groove 19 with the inner face 12*a* of the second wall portion 12. Supplemental flange wall 18 and the second wall portion 12 are both approximately right angularly disposed with reference to the web wall portion 17. Between the junction 16 of the third wall portion 13 with the second wall portion 12, and junction 27 of the second wall portion 12 with the web wall portion 17, a rib wall portion 23 of the first molding shaft 10*a* is connected to the second wall portion 12, projects laterally outwardly from the outside face 12*b* of the second wall portion 12 and longitudinally co-extends with the aforementioned several other components of the first molding shaft 10*a*, so as to impede the filling material 24 in the gap 26 and stabilize the second wall portion 12 against the existing contact surface 21.

It will also be understood that the third wall portion 13 of the first molding shaft 10*a*, in reaching laterally from the junction 15 thereof with the first wall portion 11, includes an extension 13*c* beyond the junction 16 with the second wall portion 12, thus enabling the third wall portion 13 to be regarded as a flange wall portion having a free end marginally laterally beyond the junction 16. Extension 13*c* forms a gap with a rearward free end 18*a* of the supplemental flange wall 18, thereby producing an entrance to the rearwardly laterally open longitudinal groove 19 formed as previously described. In certain embodiments, either or both the extension 13*c* and the rib wall portion 23 are omitted, still in accordance with the present invention.

A channel 30 having first and second side walls 32 and 33 disposed angularly relatively to an interconnecting back wall or web 31 is provided in the second molding shaft 10*b* and longitudinally co-extends integrally with lateral lead wall structure 36 and first and second flange walls 34 and 35 of the second molding shaft 10*b*. Lead wall structure 36 has therein a stub wall 37 which at inner end is joined at 37*a* to the channel web 31 outside the channel 30 and forms a first angle relatively to the channel web 31. A lead and contact wall 38, also being a component of the lead wall structure 36, is adapted to be fastened against the sub-structure 40 of the building. Lead and contact wall 38 has a junction 37*b* at inner end with an outer end of the stub wall 37 backward from the channel web 31 and forms a second angle with the stub wall 37. The lead and contact wall 38 reaches laterally outwardly from the stub wall 37 and outside the first side wall 32 of the channel 30 to facilitate fastening. Also, in the present embodiment, the stub wall 37 is about right angularly disposed with reference to the channel web 31 and relatively to the lead and contact wall 38, with the stub wall 37 and the channel web 31 having junction 37*a* in common with the first side wall 32 of the channel 30. In turn, the second flange wall 35 and the second side wall 33 of channel 30 are at approximately right angles to the channel web 31 having a junction 35*a* in common with the channel web 31. First flange wall 34 is a terminal flange and is outside the channel 30, is about right angularly disposed relatively to the first side wall 32 of the channel 30, and leads from a junction 34*a* with a forward end of the first side wall 32 as an aid for concealing an adjacent end of finish material 48 later to be given further mention herein.

Referring once more to FIG. 3, it will be understood that the second molding shaft 10*b*, before being fastened to the sub-structure 40, can be relatively movably interrelated with the first molding shaft 10*a*, having the latter already fastened in situ, by positioning the second molding shaft 10*b* with the channel web 31 laterally tilted and the second side wall 33 of the channel 30 inserted into the rearwardly laterally open longitudinal groove 19 formed by the first molding shaft 10*a*, and by then angularly moving the second molding shaft 10*b* upward about the rearward end 18*a* of the supplemental flange wall 18 of the first molding shaft 10*a* until the lead and contact wall 38 of the second molding shaft 10*b* is against the substantially horizontal legs 43*a* of the L-shaped frame members 40*a* and the second flange wall 35 and the second side wall 33 of the channel 30 are between extension 13*a* of the third wall portion 13 and the web wall portion 17 of the first molding shaft 10*a*. Thereafter, the lead and contact wall 38 is secured by fasteners 41 against the substantially horizontal legs 43*a* of the L-shaped frame members 40*a*. Molding shafts 10*a* and 10*b* beneficially are proportional to allow the free end of the second side wall 33 of the channel 30 and the free end of the second flange wall 35 in the second molding shaft 10*b* to be spaced, in the initially installed condition of molding shafts 10*a* and 10*b*, from the adjacent side of the web wall portion 17 and of the extension wall 13*c* in the first molding shaft 10*a*, along with a gap being formed by the molding shafts 10*a* and 10*b* between the rearward end 18*a* of the supplemental flange wall 18 and the channel web 31, and to allow the opposite sides of the second side wall 33 of the channel 30 and of the second flange wall 35 in the second molding shaft 10*b* to be in a spaced relation to the adjacent side faces of the first flange wall portion 18 and of the second wall portion 12 of the first molding shaft 10*a*, thus enabling first and second directional lateral and third directional longitudinal relative movement of the molding shafts 10*a* and 10*b* to occur freely such as in response to vibrations or shocks or movement due to expansion or contraction in the building structure. In this, it will be appreciated that the channel web 31 serves as a back wall from which the channel side wall 33 laterally projects forwardly as a flange proximately lapping the supplemental flange wall 18 inside the rearwardly laterally open longitudinal groove 19 while the aforementioned three directional relative movement is tolerated.

With the molding 10 installed, the second molding shaft 10*b* is available for finish material 48, either of a dry wall or fluent settable grade, to be applied outside the channel 30 to conceal the first side wall 32 externally of the channel 30 with the aid of the first flange wall 34 of the second molding shaft 10*b*, leaving a longitudinal laterally recessed trim reveal which includes, an exposed forward face of the web wall 17 of the first molding shaft 10*a*, an exposed side face of the supplemental flange wall 18 of the first molding shaft 10*a*, leading to inside the channel 30 of the second molding shaft 10*b*, the interior surface of the channel 30 apart from an area masked out by the supplemental flange wall 18 of the first molding shaft 10*a*, and an exposed forward face of the first flange wall 34 of the second molding shaft 10*b*. The interrelation of the installed first and second molding shafts 10*a* and 10*b* in FIG. 3 accordingly has the second side wall 33 of the channel 30 and the supplemental flange wall 18 proximately disposed lapping one another in the rearwardly laterally open longitudinal groove 19 to move one relatively to the other due to bodily relative movement of the first and second molding shafts 10*a* and 10*b*. In the longitudinal laterally recessed reveal thus produced by the plural shaft molding 10, the recess is bordered by an inner face of the supplemental flange wall 18, an inner face of first side wall 32 of the channel 30 and by an area of the channel web 31, representing a back wall area, which varies with the relative positions of the first and second molding shafts 10*a* and 10*b*. Web wall portion 17 in the first molding shaft 10*a* and terminal flange wall 34 in the second molding shaft 10*b* contribute facially to the reveal outside the reveal recess.

Terminal flange wall 34, as noted hereinbefore, also is useful as an aid for shielding the side wall 32 outside the channel 30 and an adjacent portion of the finish material 48 which is grounded against the second molding shaft 10*b*. In certain embodiments, however, still in accordance with the present invention, the terminal flange wall 34 is omitted with reliance instead being placed upon a remaining forward end of the first side wall 32 of the channel 30 to be worked to within close tolerances in concealing the first side wall 32 of the channel with finish material applied outside the channel.

Figure 5:
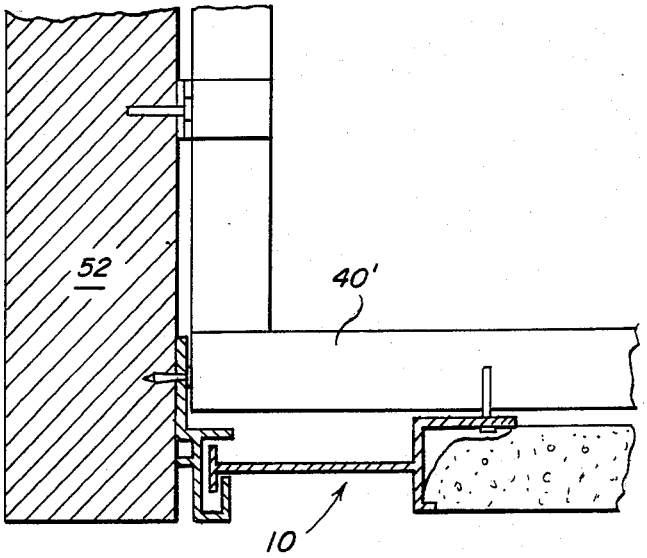
Figure 6:
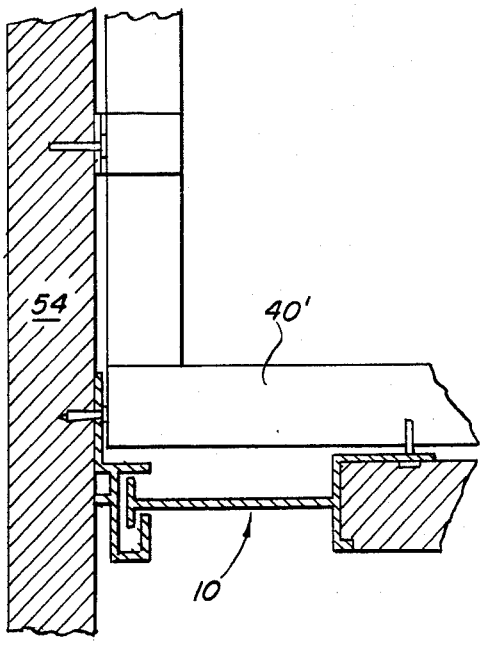

While considerable emphasis has been placed in the foregoing description upon use of the plural shaft molding 10 in a ceiling sub-structure to beam environment, it will of course be understood that the molding 10 also lends itself to use in many other possible environments, among which is a room side wall 50 to ceiling sub-structuce 40 environment as represented in FIG. 4, a column 52 to room side wall sub-structure 40' environment as represented in FIG. 5, and a room side wall 54 and sub-structural side wall 40'' corner environment as represented in FIG. 6.

Figure 7:
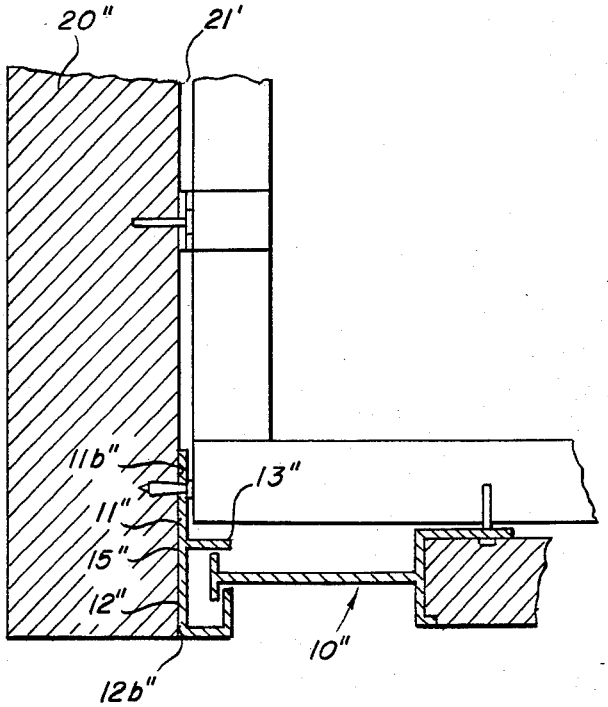
FIG. 7 represents a modified plural shaft molding assembly in an environment similar to that of FIG. 3.

In another embodiment, according to FIG. 7, and still within the scope of the present invention, a plural molding shaft 10'' is provided similar to the molding shaft 10 except that, while the first, second and third wall portions 11'', 12'' and 13'' are still about right angularly disposed with reference to one another, their first ends are in a junction 15'' in common to have the outside faces 11*b*'' and 12*b*'' of the first and second wall portions 11'' and 12'' both be against face 21'' of the first structural body 20'' when the first wall portion 11'' is fastened to the structural body 20''.

Figure 8:
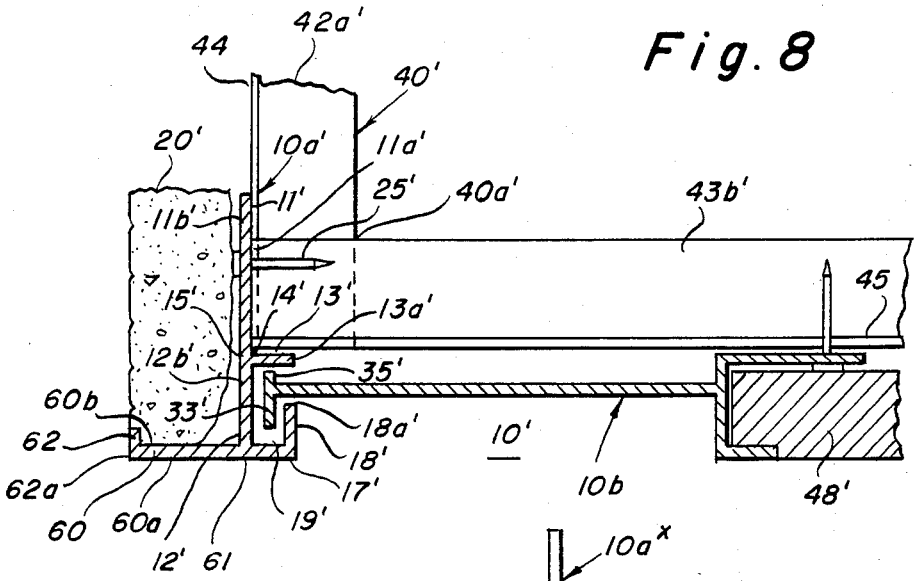
FIG. 8 is an assembly view of a further form of plural shaft molding with the molding being in a soffit installation.

A modified plural molding shaft 10', also in accordance with the present invention, is represented in FIG. 8 as being in a building side wall down to soffit installation to illustrate use of the molding wherein both the first and second molding shafts 10*a*' and 10*b*' are fastened to the sub-structure 40' having the two shafts associated with structural bodies 20' and 48' each either of a dry wall or of a fluent settable material type. Accordingly, the building has a plurality of L-shaped frame members 40*a*' therein, one of which is visible in FIG. 8, with each including a substantially vertical leg 42*a*' and a substantially horizontal leg 43*a*' suitably rigidly secured in the building in a manner not shown, and spaced side by side from one another in depth of FIG. 8 so as to be portions of a sub-structural soffit framework. In the particular installation represented, a sub-structural corner is afforded by sub-structural coverings 44 and 45, such as lath or sub-structural boarding, fastened to the outsides of the L-shaped frame members 40*a*' and serving as a backing for the finish material 20' and 48', though in other instances, particularly where the finish material 20' or 48' is of the dry wall type, the sub-structural cover is omitted in favor of using the sub-structural framework 40' directly to introduce the sub-structural corner in a framework sense.

Still with reference to FIG. 8, the first molding shaft 10*a*' in the molding 10' is characterized by having first and second wall portions 11' and 12' and a third wall portion 13' joined at first ends thereof in common at 15', and having the third wall portion 13' about right angularly disposed relatively to the first and second wall portions 11' and 12', thus forming a corner 14' in the first molding shaft 10*a*'. *First wall portion 11' is fastened by suitable fasteners 25' to the sub-structure 40' while having an inside face 11a'* of the first wall portion and a rearwardlly directed face 13*a*' of the third wall portion 13' against the sub-structural corner. The second wall portion 12' laterally leads forwardly in shaft 10*a*' outside the corner 14' and lies substantially in a plane in common with the first wall portion 11' at outside faces 11*b*' and 12*b*' of the first and second wall portions 11' and 12' for a longitudinally straight condition of the first molding shaft 10*a*'. An extension wall portion 60 of the first molding shaft 10*a*' is about right angularly disposed with reference to the second wall portion 12' and at inner end has a junction 61 in common with an outer second end of the second wall portion 12' and an inner end of a web wall portion 17'. A terminal flange wall portion 62 is joined to the outer end of the extension wall portion 60 and is about right angularly directed upwardly from the extension wall portion 60 as an aid for concealing an adjacent end of the first finish material 20' when the first finish material is brought contiguous to a rearward face **60*b* of the extension wall portion 60, still to reveal the outside face 62*a* of the terminal flange wall portion 62 and also have the forward face 60*a* of the extension wall portion 60** revealed.

At inside face, the second wall portion 12' forms a rearwardly laterally open longitudinal groove 19' with the aforementioned web wall portion 17' and a supplemental flange wall 18' of the first molding shaft **10*a*'. Web wall portion 17' for interconnecting the second wall portion 12' with the supplemental flange wall 18' is about right angularly disposed with reference to each of those members and joins the forward second end of the second wall portion 12' with a forward end of the supplemental flange wall 18', the latter rearwardly in the molding shaft 10*a*' having a free end 18*a*' forming a gap with the third wall portion 13' while having the rearwardly laterally open longitudinal groove 19' opposite the side wall portion 13'. The first molding shaft 10*a*', accordingly constructed, is, for example, used with a second molding shaft 10*b* constructed and installed in a manner similar to that described with reference to FIG. 3**.

Figure 9:
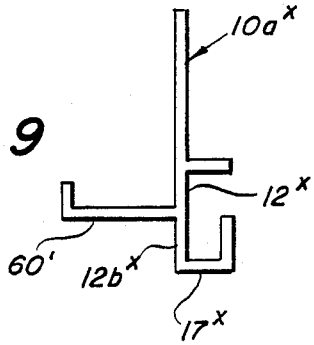
FIG. 9 is a longitudinal end view of a modified molding shaft which for example is adapted to be substituted for one of the molding shafts in the molding of FIG. 8.

In a modification, also within the scope of the present invention, and represented in FIG. 9, the plural shaft molding is similar to that of FIG. 8, except that still with having the web wall portion 17$^x$ in the first molding shaft **10*a*$^x$ joined to the outer second end of the second wall portion 12$^x$, the extension wall portion 60' is stepped backwardly in the first molding shaft 10*a*$^x$ and is separately joined to the second wall portion 12$^x$, thus leaving a portion of the outside face 12*b*$^x$ of the second wall portion 12$^x$** to be revealed in the plural shaft molding when installed.

Figure 10:
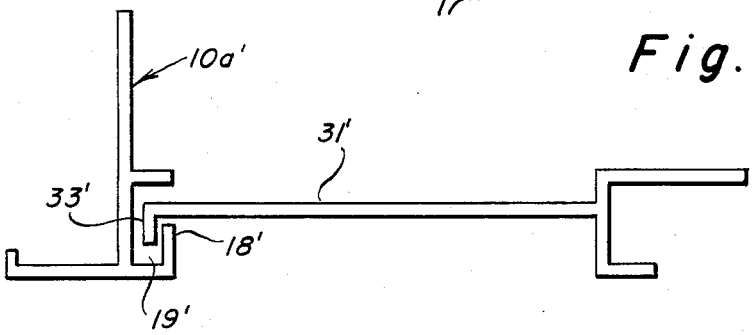
FIGS. 10 and 11 are longitudinal end views of molding shaft assemblies offering further modifications when for example compared with FIG. 8.
Figure 11:
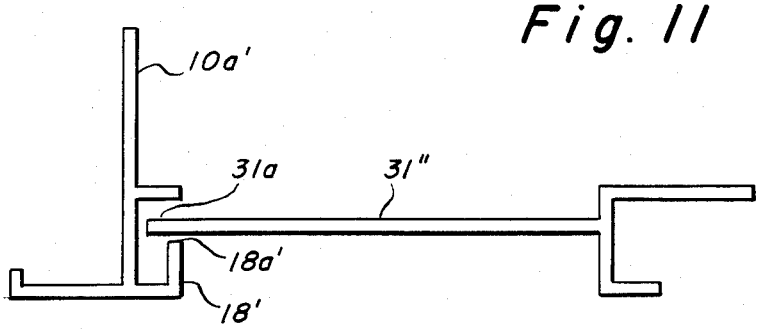

In certain embodiments in accordance with the present invention, and to be understood through referring to FIGS. 10 an 11, a plural shaft molding is provided having a first molding shaft similar to any of those hereinbefore described, typically a first molding shaft **10*a*' according to FIG. 8, and having a modified second molding shaft which is constructed and used similarly to the second molding shaft 10*b* hereinbefore described with reference to FIG. 3. In the FIG. 10 embodiment, however, the channel side wall 33' is the sole lateral projection from that same end of the channel web 31' so as to enter the rearwardly laterally open longitudinal groove 19' in the first molding shaft and proximately lap the supplemental flange wall 18' of the first molding shaft, for the first molding shaft and the modified second molding shaft relatively to move in first and second lateral directions and longitudinally in a third direction. In the FIG. 11 embodiments the modified second molding shaft is provided with a back wall 31' having a free end portion 31*a* adapted to be proximate to a free end 18*a*' of the supplemental flange wall 18' of the first molding shaft and to be moved meanwhile in first and second directions laterally and in a third direction longitudinally with the modified second molding shaft relatively to the first molding shaft while the free end 18*a*' of the supplemental flange wall 18' is lapped by the free end portion 31*a* of the back wall 31''**.

Figure 12:
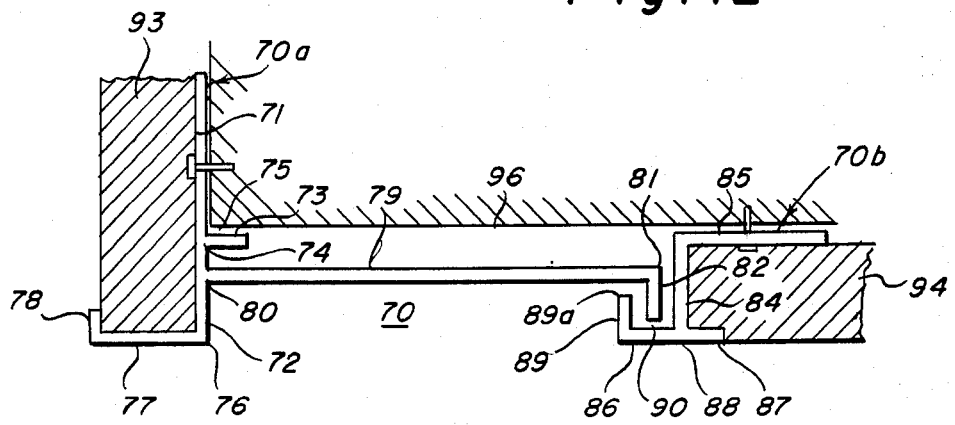
FIGS. 12, 13 and 14 are representations of further assemblies with plural shaft moldings provided in accordance with the present invention.

Other embodiments within the scope of the present invention have a supplemental flange wall in the reveal recess as a portion of the second molding shaft, and a back wall in the reveal recess as a portion of the first molding shaft. Thus, typically, a plural shaft molding 70, represented in FIG. 12, comprises first and second molding shafts **70*a* and 70*b*. First, second and third wall portions 71, 72 and 73 have a junction 74 in common at first ends thereof with the first and third wall portions 71 and 73 forming a substantially right angular corner 75 to be receptive to sub-structure 96 of a building with which the first and second molding shafts 70*a* and 70*b* are associated. The second wall portion 72 leads laterally forwardly from the junction 74 and has a forward second end joined at 76 to an extension wall portion 77 which laterally leads outside the second wall portion 72 and is joined at outer end to a terminal flange wall 78. The extension wall portion 77 is about right angularly related to the second wall portion 72 and to the terminal flange wall 78. A back wall 79 has one of its ends joined at 80 to the second wall portion 72, intermediately of the junctions 74 and 76, and laterally leads about right angularly disposed relatively to the second wall portion 72 from an inside face of the second wall portion 72 and has its other end joined at 81 to a laterally forwardly leading flange wall 82 which is about right angularly disposed with reference to the back wall portion 79**.

Second molding shaft **70*b* includes a side wall 84 interconnecting a lead and contact wall 85 at an inner end of the latter rearwardly in the second molding shaft 70*b* with a web wall 86 and a terminal flange 87, the side wall 84 having a junction 88 in common with the latter two components, forwardly in the second molding shaft 70*b*. Web wall 86 and a supplemental flange wall 89 form a rearwardly laterally open longitudinal groove 90 with an inside face of the side wall 84 for the laterally forwardly leading flange wall 82 of the first molding shaft 70*a* to be inserted into that groove. The lead and contact wall 85 laterally reaches outwardly beyond the side wall 84 and is fastened to sub-structure 96 of the building while the sub-structure 96 also is received in the corner 75 in the first molding shaft 70*a* and the first molding shaft 70*a* has the first wall portion 71 thereof fastened to the building. Meanwhile, the back wall portion 79 of the second molding shaft 70*b* is situated proximately to the free end 89*a* of the supplemental flange wall 89 for being moved relatively to the free end 89*a*, with the laterally forwardly leading flange wall 82 also being movably in the rearwardly laterally open longitudinal groove 90. Notably, too, the laterally forwardly leading flange wall 82 proximately laps the supplemental flange wall 89 inside the rearwardly laterally open longitudinal groove 90 so as to have the first and second molding shafts 70*a* and 70*b* relatively movable in first and second lateral directions and in a longitudinal third direction. First and second finish materials 93 and 94 accordingly are used against the plural shaft molding 70. Material 93 is contiguous to the adjacent outside faces of the first and second wall portions 71 and 72 and to the rearward face of the extention wall portion 77 while concealed at the end by the terminal flange 78 and by the extension wall portion 77. Material 94 is concealed at the end by terminal flange 87 while adjacent to the outside face of side wall 84**.

Figure 13:
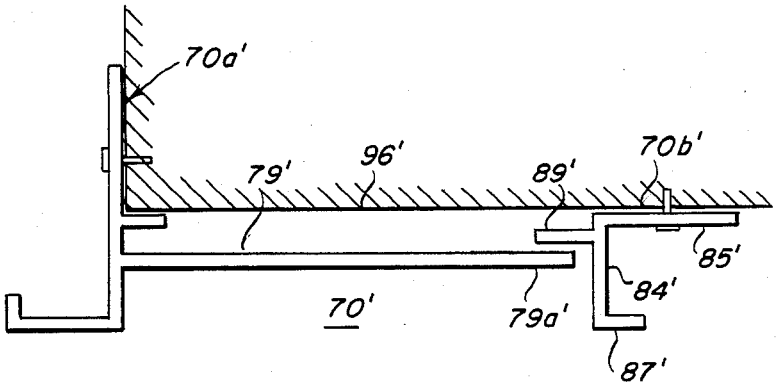

In still other embodiments in accordance with the present invention, the back wall provided to be in the reveal recess and forming a component of one of the two molding shafts, and the supplemental flange wall forming a component of the other of the two molding shafts, are in the installed condition of the plural shaft molding similarly laterally directed, though in opposite senses, so as to be proximately lapped one with reference to the other, thus enabling first and second directional lateral relative movement and third directional longitudinal relative movement of the two shafts while forming the recessed reveal. Thus, from the embodiment represented in FIG. 13, it will be understood that the first molding shaft 70*a*', being receptive to sub-structure 96' of a building and affixed to that sub-structure, is similar to that disclosed with reference to FIG. 12 except for the back wall 79' simply having a free end portion 79*a*'. The second molding shaft is characterized by including a lead and contact wall 85' which also is secured to the building sub-structure 96'. A side wall 84' of the second molding shaft interconnects the inner end of terminal flange 87' and an inner end of a lead the and contact wall 85' and is about right angularly disposed with reference to both of those portions, having the lead and contact wall 85' and the terminal flange 87' laterally lead outwardly from the side wall 84'. Supplemental flange wall 89' has a junction with the side wall 84' intermediately of the ends of the latter and laterally leads about right angularly disposed with reference to the side wall 84' from the inside face of the side wall 84' to be lapped by the end portion 79*a*' of the back wall 79' for these portions to be proximately three directionally relatively movable after the plural shaft molding including the first and second molding shafts 70*a*' and 70*b*' has been installed. Notably, the end portion 79*a*' of the back wall 79', in lapping the supplemental flange wall 89', is preferably disposed forwardly of the supplemental flange wall 89' and proximate to the inside face of the side wall 84' to reduce visible effects of the lap joint.

Figure 14:
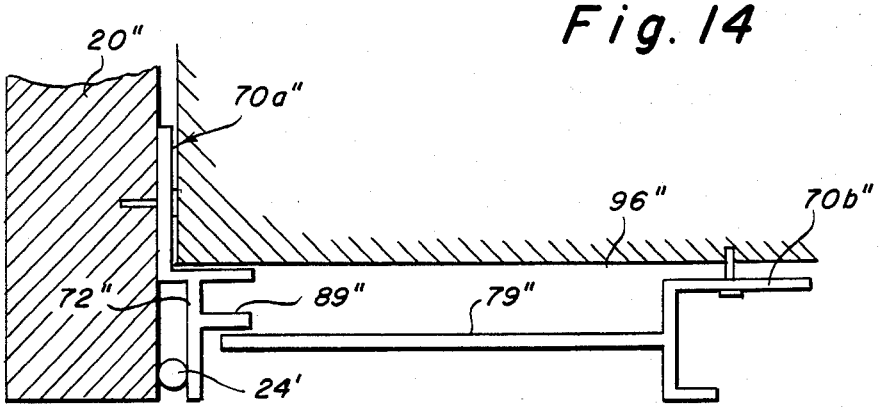

From FIG. 14, it will be understood that in the embodiment of this invention therein represented, the connections of the back wall 79'' and the supplemental flange wall 89'' are reversed so as to have the back wall 79'' be a component of the second molding shaft 70*b*'' and the supplemental flange wall 89'' be a component of the first molding shaft 70*a*'', the second side wall portion 72'' moreover being indented in the first molding shaft 70*a*'' in order to form with a structural body 20'' in a building a gap for a filling 24' while having the first molding shaft 70*a*'' fastened to body 20'', and while having the second molding shaft 70*b*'' secured to sub-structure 79'' of the building with the sub-structure 79'' cornered against the first molding shaft 70*a*''.

As the invention lends itself to many possible embodiments and as many possible changes may be made in the embodiments hereinbefore set forth, it will be distinctly understood that all matter described herein is to be interpreted as illustrative and not as a limitation.

I claim:

1. A plural shaft molding adapted to be associated with sub-structure of a building and be facially opposed by first and second structural bodies, at least said second structural body being of a dry wall or of a fluent settable coating type, and said molding comprising first and second molding shafts, said first molding shaft including, a first wall portion adapted to be fastened to said building, and second and third wall portions, said third wall portion being joined at a first end thereof to a first end of said first wall portion so that a rearward face of said third wall portion forms a corner in said first molding shaft with an inside face of said first wall portion, and said second wall portion having a first end joined to said third wall portion and said second wall portion laterally leading forwardly angularly disposed relatively to said third wall portion outside said first molding shaft corner, for said sub-structure to be disposed in part inside said corner with said first wall portion fastened to said building and said first structural body facially to be continuous to outside faces of said first and second wall portions and to a recessed reveal to be introduced by said first and second molding shafts; said second molding shaft including, a side wall having an outside face to be concealed by said second structural body contiguous to said reveal, and a lead and contact wall connected at an inner end thereof to a first end of said side wall and adapted to be fastened to said sub-structure; and said first and second molding shafts further including, a back wall and lapping portion connected with either one of said side wall of said second molding shaft and said second wall portion of said first molding shaft intermediately of said first end and a second end of said one of said side wall of said second molding shaft and said second wall portion of said first molding shaft, and a supplemental flange wall connected with the other of said second wall portion of said first molding shaft and said side wall of said second molding shaft, for said supplemental flange wall and said back wall and lapping portion to be between an inside face of said second wall portion of said first molding shaft and an inside face of said side wall of said second molding shaft and said first and second molding shafts to introduce said reveal having said back wall and lapping portion contribute facially in said recess to said reveal, and said back wall and lapping portion to lap said supplemental flange wall proximately thereto and proximately to said inside face of said other of said second wall portion of said first molding shaft and said side wall of said second molding shaft, having said back wall and lapping portion for lapping and said supplemental flange wall relatively movable with reference to one another laterally in first and second directions and longitudinally in a third direction, while having said sub-structure in part inside said corner in said first molding shaft, said first wall portion of said first molding shaft fastened to said building, and said first structural body contiguous to said outside faces of said first and second wall portions of said first molding shaft and to said reveal, with said lead and contact wall of said second molding shaft meanwhile fastened to said sub-structure, and said outside face of said side wall of said second molding shaft concealed by said second structural body contiguous to said reveal.

2. A plural shaft molding as set forth in claim 1, wherein said back wall and lapping portion includes a back wall and a laterally forwardly projecting flange wall connected with said back wall, and a web wall interconnects said supplemental flange wall with said second end of said other of said second wall portion of said first molding shaft and said side wall of said second molding shaft, and forms a rearwardly laterally open longitudinal groove with said supplemental flange wall and said inside face of said other of said second wall portion of said first molding shaft and said side wall of said second molding shaft, for said supplemental flange wall to be proximately lapped by said laterally forwardly projecting flange wall inside said rearwardly laterally open longitudinal groove.

3. A plural shaft molding as set forth in claim 2, wherein said back wall interconnects said laterally forwardly projecting flange wall with said side wall of said second molding shaft and said web wall interconnects said supplemental flange wall with said second wall portion of said first molding shaft.

4. A plural shaft molding as set forth in claim 2, wherein said back wall interconnects said laterally forwardly projecting flange wall with said second wall portion of said first molding shaft and said web wall interconnects said supplemental flange wall with said side wall of said second molding shaft.

5. A plural shaft molding as set forth in claim 3, wherein, in said first molding shaft, said first side wall portion is adapted to be fastened to an initially in situ said first structural body, and said second wall portion is indented to form a gap along said outside face of said second wall portion for a filling with a face of said first structural body while said outside face of said first wall portion is against said face of said first structural body and said first wall portion is fastened to said first structural body.

6. A plural shaft molding as set forth in claim 3, wherein said first and second molding shafts are adapted to be associated with said first and second structural bodies each being either of a dry wall or of a fluent settable coating type, and wherein, in said first molding shaft, said first wall portion is adapted to be fastened to said sub-structure having said sub-structure in part inside said corner in said first molding shaft, and wherein said first molding shaft further includes an extension wall portion joined to said second wall portion and laterally leading outwardly from said outside face of said second wall portion angularly disposed with reference to said second wall portion, said extension wall having a forward face to be in said reveal and a rearward face to be concealed by said first structural body when said first structural body is against said outside face of said first wall portion and is contiguous to said second wall portion after said first and second molding shafts have been installed.

7. A plural shaft molding as set forth in claim 1, wherein said back wall and lapping portion includes a back wall having a free end portion of said back wall for lapping, and said supplemental flange wall is connected with said other of said second wall portion of said first molding shaft and said side wall of said second molding shaft intermediately of said first end of said other of said second wall portion of said first molding shaft and said second end of said other of said second wall portion of said first molding shaft and said side wall of said second molding shaft, to be proximately lapped by said free end portion of said back wall.

8. A plural shaft molding as set forth in claim 1, wherein said back wall and lapping portion includes a back wall having a free end portion of said back wall to be lapped, and a web wall interconnects said supplemental flange wall with said second end of said other of said second wall portion of said first molding shaft and said side wall of said second molding shaft, and forms a rearwardly laterally open longitudinal groove with said supplemental flange wall and said inside face of said other of said second wall portion of said first molding shaft and said side wall of said second molding shaft, for a free end of said supplemental flange wall to be proximately lapped by said free end portion of said back wall.

9. A plural shaft molding as set forth in claim 1, wherein, in said first molding shaft, said first wall portion is adapted to be fastened to an initially in situ said first structural body, and said second wall portion is indented to form a gap along said outside face of said second wall portion for a filling with a face of said first structural body while said outside face of said first wall portion is against said face of said first structural body and said first wall portion is fastened to said first structural body.

10. A plural shaft molding as set forth in claim 1, wherein said first and second molding shafts are adapted to be associated with said first and second structural bodies each being either of a dry wall or of a fluent settable coating type, and wherein, in said first molding shaft, said first wall portion is adapted to be fastened to said sub-structure having said sub-structure in part inside said corner in said first molding shaft, and wherein said first molding shaft further includes an extension wall portion joined to said second wall portion and laterally leading outwardly from said outside face of said second wall portion angularly disposed with reference to said second wall portion, said extension wall portion having a forward face to be in said reveal and a rearward face to be concealed by said first structural body when said first structural body is against said outside face of said first wall portion and is contiguous to said second wall portion after said first and second molding shafts have been installed.

11. A plural shaft molding adapted to be associated with sub-structure of a building and be facially opposed by first and second structural bodies, at least said second structural body being of a dry wall or of a fluent settable coating type, and said molding comprising first and second molding shafts, said first molding shaft including, a first wall portion adapted to be fastened to said building, and second and third wall portions, said third wall portion being joined at a first end thereof to a first end of said first wall portion so that a rearward face of said third wall portion forms a corner in said first molding shaft with an inside face of said first wall portion, and said second wall portion having a first end joined to said third wall portion and said second wall portion laterally leading forwardly angularly disposed relatively to said third wall portion outside said first molding shaft corner, for said sub-structure to be disposed in part inside said corner with said first wall portion fastened to said building and said first structural body facially to be contiguous to outside faces of said first and second wall portions and to a recessed reveal to be introduced by said first and second molding shafts; said second molding shaft including, a lead and contact wall adapted to be fastened to said sub-structure, a stub wall joined at outer end to an inner end of said lead and contact wall and angularly disposed relatively to said lead and contact wall, and a side wall having an outside face to be concealed by said second structural body contiguous to said reveal; and said first and second molding shafts further including, a back wall and lapping portion connected with either on the one hand said stub wall and said side wall of said second molding shaft at inner ends of said stub wall and said side wall and on the other hand with said second wall portion of said first molding shaft, and a supplemental flange wall connected with the other of said second wall portion of said first molding shaft and said inner ends of said stub wall and said side wall of said second molding shaft, for said back wall and lapping portion to be disposed leading proximately to said supplemental flange wall and to an inside face of either said second wall portion of said first molding shaft and said side wall of said second molding shaft that is connected with said supplemental flange wall and lap said supplemental flange wall relatively movably therewith in laterally first and second directions and in longitudinally a third direction having a facial area of said back wall and lapping portion revealed in said recess of said reveal, and for said lead and contact wall meanwhile to lead laterally from said stub wall outwardly beyond said side wall of said second molding shaft and be fastened to said sub-structure with said outside face of said side wall of said second molding shaft disposed to be concealed contiguous to said reveal by said second structural body, while said sub-structure in part is inside said corner in said first molding shaft and said first molding shaft is fastened to said building for said first structural body to be contiguous to said outside faces of said first and second wall portions of said first molding shaft and to said reveal.

12. A plural shaft molding as set forth in claim 11 wherein, in said first molding shaft, a web wall interconnects said supplemental flange wall with a second end of said second wall portion and forms a rearwardly laterally open longitudinal groove with said supplemental flange wall and said inner face of said second wall portion and, wherein said second molding shaft includes said back wall and lapping portion, and said back wall and lapping portion comprises a back wall and a laterally forwardly projecting flange wall connected to said back wall to lap said supplemental flange wall inside said rearwardly laterally open longitudinal groove.

13. A plural shaft molding as set forth in claim 12, wherein, in said first molding shaft, said first wall portion is adapted to be fastened to an initially in situ said first structural body, and said second wall portion is indented to form a gap along said outside face of said second wall portion for a filling with a face of said first structural body while said outside face of said first wall portion is against said face of said first structural body and said first wall portion is fastened to said first structural body.

14. A plural shaft molding as set forth in claim 12, wherein said first and second molding shafts are adapted to be associated with said first and second structural bodies each being either of a dry wall or of a fluent settable coating type, and wherein, in said first molding shaft, said first wall portion is adapted to be fastened to said sub-structure having said sub-structure in part inside said corner in said first molding shaft, and wherein said first molding shaft further includes an extension wall portion joined to said second wall portion and laterally leading outwardly from said outside face of said second wall portion angularly disposed with reference to said second wall portion, said extension wall portion having a forward face to be in said reveal and a rearward face to be concealed by said first structural body when said first structural body is against said outside face of said first wall portion and is contiguous to said second wall portion after said first and second molding shafts have been installed.

15. A plural shaft molding as set forth in claim 14, wherein said second wall portion, said web wall and said extension wall portion have a junction in common in said first molding shaft.

16. A plural shaft molding as set forth in claim 15, wherein said side wall, said stub wall, and said back wall and lapping portion have a junction in common in said second molding shaft.

17. A plural shaft molding as set forth in claim 11, wherein said second molding shaft includes said supplemental flange wall connected with said inner ends of said stub wall and said side wall of said second molding shaft, and said back wall and lapping portion, being connected with said second wall portion of said first molding shaft intermediately of said first end of said second wall portion and a second end of said second wall portion, includes a back wall, and a free end portion of said back wall to proximately lap said supplemental flange wall.

18. A plural shaft molding as set forth in claim 11, wherein said first molding shaft includes said supplemental flange wall connected with said second wall portion intermediately of said first end of said second wall portion and a second end of said second wall portion, and said back wall and lapping portion, being connected with said inner ends of said stub wall and said side wall of said second molding shaft, includes a back wall, and a free end portion of said back wall to proximately lap said supplemental flange wall.

19. A plural shaft molding as set forth in claim 1, wherein a web wall interconnects said supplemental flange wall with said second end of said other of said second wall portion of said first molding shaft and said side wall of said second molding shaft, and forms a rearwardly laterally open longitudinal groove with said supplemental flange wall and said inside face of said other of said second wall portion of said first molding shaft and said side wall of said second molding shaft, and said back wall and lapping portion comprises a back wall for said back wall laterally to lap past said free end of said supplemental flange wall.

20. A plural shaft molding as set forth in claim 11, wherein, in said first molding shaft, a web wall interconnects said supplemental flange wall with a second end of said second wall portion and forms a rearwardly laterally open longitudinal groove with said supplemental flange wall and said inner face of said second wall portion, and wherein said second molding shaft includes said back wall and lapping portion, and said back wall and lapping portion comprises a back wall for said back wall laterally to lap past a free end of said supplemental flange wall.

* * * * *